United States Patent [19]

Takahashi et al.

[11] Patent Number: 4,811,585

[45] Date of Patent: Mar. 14, 1989

[54] DEVICE FOR FORMING ASYMMETRICAL ARTICLES BY ROLLING

[75] Inventors: Ryoichi Takahashi, Fuji; Tomoyoshi Sato, Fujisawa; Hidehiko Tsukamoto, Hiroshima; Kazuo Morimoto, Hiroshima; Nobutaka Maeda, Hiroshima, all of Japan

[73] Assignees: Nissan Motor Co., Ltd., Yokohama; Mitsubishi Jukogyo Kabushiki Kaisha, Tokyo, both of Japan

[21] Appl. No.: 32,109

[22] Filed: Mar. 30, 1987

[30] Foreign Application Priority Data

| | | | |
|---|---|---|---|
| Apr. 2, 1986 | [JP] | Japan | 61-75954 |
| Apr. 2, 1986 | [JP] | Japan | 61-75955 |
| Apr. 16, 1986 | [JP] | Japan | 61-87704 |
| Sep. 30, 1986 | [JP] | Japan | 61-150140 |

[51] Int. Cl.[4] ..... B21D 7/00; B21K 1/08

[52] U.S. Cl. ..... 72/108; 72/88; 72/469; 29/6

[58] Field of Search ..... 72/88, 90, 102, 108, 72/469; 29/6

[56] References Cited

U.S. PATENT DOCUMENTS

| | | | |
|---|---|---|---|
| 352,365 | 11/1886 | Simonds | 72/469 |
| 382,710 | 5/1888 | Laundry | 72/90 |
| 1,339,023 | 5/1920 | Cole | 72/90 |
| 2,183,688 | 12/1939 | Olson | 72/88 |

FOREIGN PATENT DOCUMENTS

| | | | |
|---|---|---|---|
| 52847 | 4/1977 | Japan | 72/88 |
| 118347 | 6/1985 | Japan | 72/108 |
| 599899 | 3/1978 | U.S.S.R. | 72/469 |
| 247082 | 2/1926 | United Kingdom . | |
| 678776 | 9/1952 | United Kingdom . | |
| 730320 | 5/1955 | United Kingdom . | |

*Primary Examiner*—Daniel C. Crane

*Attorney, Agent, or Firm*—Foley & Lardner, Schwartz, Jeffery, Schwaab, Mack, Blumenthal & Evans

[57] ABSTRACT

A pair of dies are provided of which die faces are formed with depressions sequentially brought into engagement with a particular portion of a workpiece as the workpiece rolls between the die faces. By compressing the workpiece while driving the same to roll between the die faces, an excess metal of the workpiece is caused to flow into the depressions sequentially for thereby forming an asymmetrical part of the article.

12 Claims, 13 Drawing Sheets

DEVICE FOR FORMING ASYMMETRICAL ARTICLES BY ROLLING

BACKGROUND OF THE INVENTION

1. Field of the Invention

The present invention relates in general to rolling by using two or three cylindrical dies or a pair of flat or straight dies and more particularly to a method of and device for forming an asymmetrical article such as a shaft having a radial projection or an eccentric shaft section by rolling.

2. Description of the Prior Art

A rolling process has been widely used in production of metal articles such as stepped shafts since no stock is wasted in rolling the articles and the rolled product is superior in strength to the cut product. However, asymmetrical articles such as a shaft having a radial projection or an eccentric shaft section cannot be formed by the prior art rolling process.

For this reason, in production of some asymmetrical aticles, a forging process for forming an intermediate product into a finished shape has been indispensable in addition to a rolling process for forming a workpiece into the intermediate product.

SUMMARY OF THE INVENTION

In accordance with the present invention, there is provided a method of forming an asymmetrical article by rolling, which comprises preparing a plurality of dies of which die faces are formed with independent patterns sequentially brought into engagement with a particular portion of a workpiece as the workpiece rolls between the die faces, and compressing the workpiece while driving the same to roll between the die faces and forming the particular portion of the workpiece into an asymmetrical portion of the article by the effect of the patterns of the die faces.

In accordance with the present invention, there is also provided a device for forming an asymmetrical article by rolling, which comprises a plurality of dies of which die faces are formed with independent patterns sequentially brought into engagement with a particular portion of a workpiece for thereby forming an asymmetrical part of the workpiece at the particular portion.

The above method and device make it possible to form an asymmetrical article by rolling.

It is accordingly an object of the present invention to provide a method of forming an asymmetrical article by rolling.

It is a further object of the present invention to provide a device for forming an asymmetrical article by rolling.

It is a further object of the present invention to provide a method of forming a crankshaft, which can reduce the manufacturing expense.

DETAILED DESCRIPTION OF THE PREFERRED EMBODIMENTS

Figure 1:
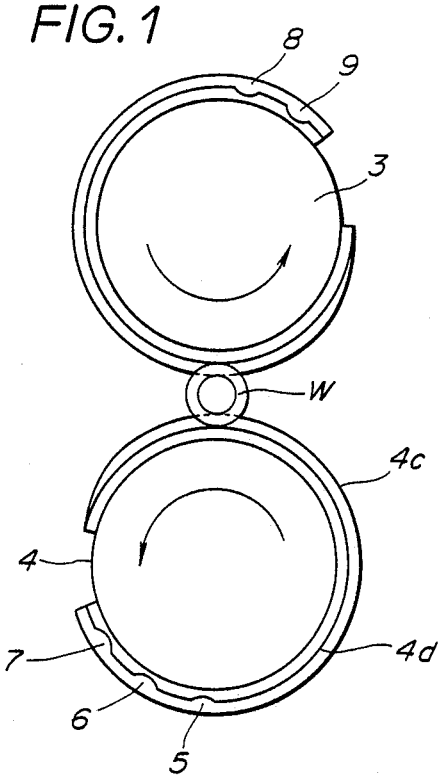
FIG. 1 is a side elevational view of a pair of cylindrical dies according to an embodiment of the present invention.
Figure 7:
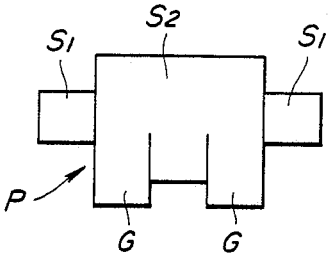
FIG. 7 is an elevational view of an asymmetrical article to be rolled by the dies of FIG. 1.
Figure 8:
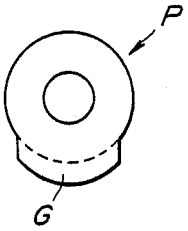
FIG. 8 is a side view of the article of FIG. 7.

FIGS. 1 and 2 show a pair of cylindrical dies 3, 4 according to an embodiment of the present invention. The dies 3, 4 are adapted so as to be capable of rolling an asymmetrical product or article P as shown in FIGS. 7 and 8. The article P is in the form of a stepped shaft having a pair of smaller diameter sections $S_1$, $S_1$ and a larger diameter section $S_2$ interposed therebetween. While the shaft sections $S_1$, $S_2$ are all arranged concentric, the larger diameter section $S_2$ has a pair of axially spaced projections G, G which are aranged asymmetric about the axis of the article P.

Figure 2A:
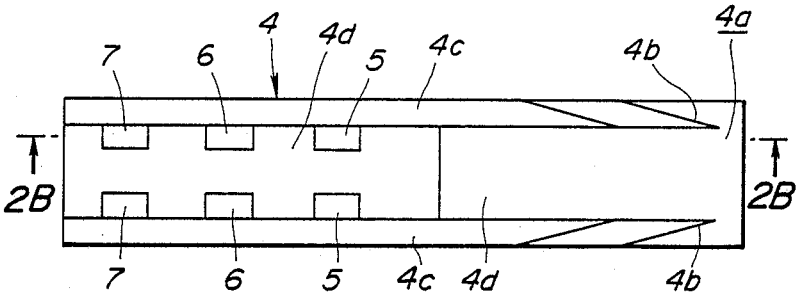
FIG. 2A is a developed view of the die face of one of the cylindrical dies of FIG. 1.
Figure 2B:
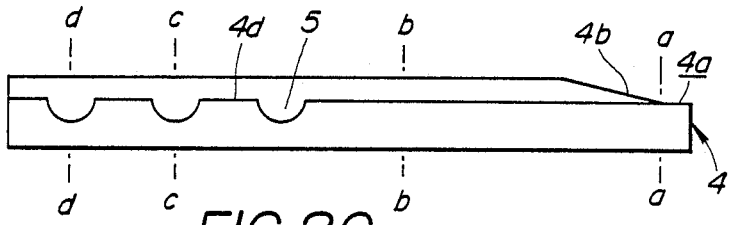
FIG. 2B is a sectional view taken along the line 2B—2B of FIG. 2A.

As seen from FIG. 1, the dies 3, 4 have substantially the same shape except for the number and position of grooves or depressions and adapted to be driven by an unshown driving means. Referring to FIGS. 2A and 2B, the die face 4*a* of the die 4 has a pair of first working sections 4*c*, 4*c* in the form of ridges spaced in the width direction of the die 4. The first working sections 4*c*, 4*c* each have biting ends 4*b*, 4*b* biting into a workpiece W at the begining of rolling for forming the smaller diameter sections $S_1$, $S_1$ of the article P. The die face 4*a* also has a second working section 4*d* between the first working sections 4*c*, 4*c* for forming the larger diameter section $S_2$ of the article P.

Figure 2C:
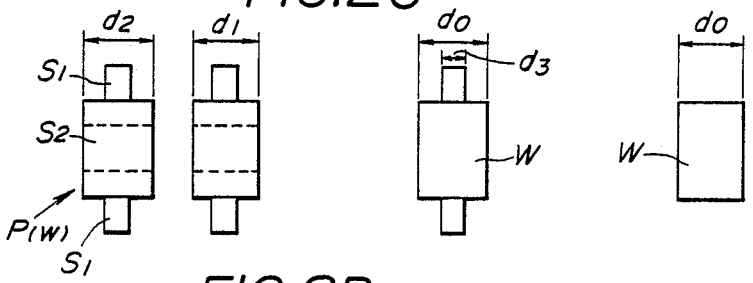
FIG. 2C is an elevational view of variously shaped workpieces obtained at each stages a—a, b—b, c—c, d—d of FIG. 2B.
Figure 2D:
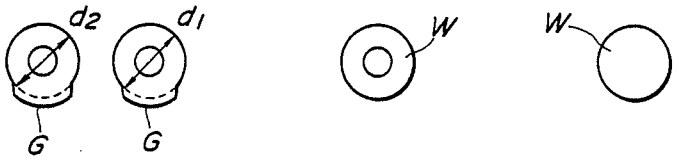
FIG. 2D is a side view of the workpieces of FIG. 2C.

As seen from FIGS. 2B and 2C, rolling of the workpiece W which is originally a straight round bar of the diameter $d_0$ begins as the process advances from the stage a—a to the stage b—b. In response to this, the opposite ends of the workpiece W start reducing in diameter by the effect of the first working sections 4*c*, 4*c* and formed into the smaller diameter sections $S_1$, $S_1$ of the diameter $d_3$. At the stage transitting from b—b to d—d, the central portion of the workpiece W reduces in diameter from $d_0$ to $d_l$ and then $d_1$ to $d_2$ and formed into the larger diameter section $S_2$ by the effect of the second working section 4*d* which is provided with a predetermined inclination in the place corresponding to the stage transitting from b—b to d—d.

The second working section 4*d* is formed with plural pairs of depressions 5, 6, 7 for forming the radial depressions G, G of the article P, each pairs of which depressions are spaced from each other in the width direction of the die 4 by the amount corresponding to the distance between the projections G, G. The depressions 5, 6, 7 are arranged at the same intervals, i.e., at an equal pitch in the longitudinal direction of the die 4. The pitch of the depressions 5, 6, 7 is set substantially equal to the distance over which the workpiece W rolls by one revolution, i.e., the circumference of the workpiece W so that an excess metal of the workpiece W is caused to flow progressively into the depressions 5, 6, 7 and formed into the radial prejections G, G as shown in FIGS. 7 and 8.

Referring to FIGS. 3A to 3E, the rolling process by using the dies 3, 4 of this invention will be described more in detail hereinafter. The die 3 is substantially similar to the die 4 except for depressions 8, 9. The depressions 8, 9 are formed so as to be equal in pitch to the depressions 5, 6, 7 but differ from same in position relative to the workpiece W by the distance over which the workpiece W rolls by about half revolution, i.e., differ from the depressions 5, 6, 7 in phase by the amount corresponding to about half revolution of the workpiece W so that any one of the depressions 8, 9 of one die 4 and any one of the depressions 5, 6, 7 of the other die 3 do not come in contact with the workpiece W at the same time.

Figure 3A:
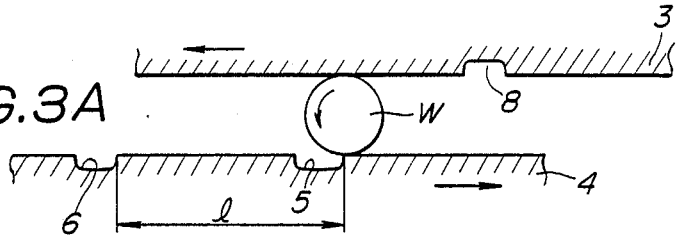
FIGS. 3A–3E are schematic views for showing how a workpiece is formed into an asymmetrical article by using the dies of FIG. 1.
Figure 3B:
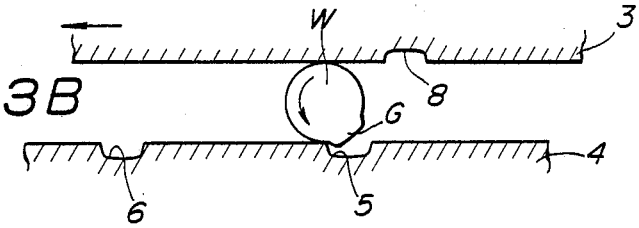
Figure 3C:
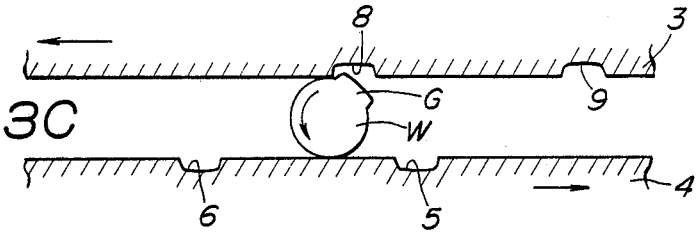
Figure 3D:
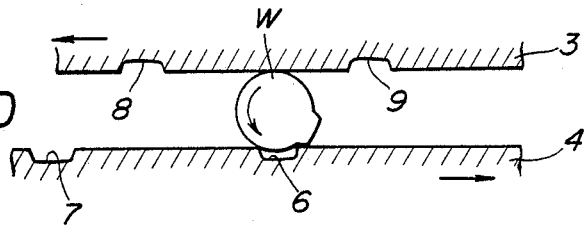
Figure 3E:
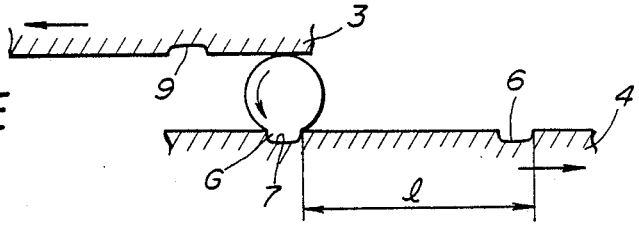

In FIG. 3A, the workpiece W is shown as being coming in contact with the depression 5. An excess metal of the workpiece W resulting from the reduction in diameter of the central portion thereof is thus caused to flow into the depression 5 and formed into a radial projection G as shown in FIG. 3B. As the rolling process advances further, the projection G having been formed by the depression 5 comes in engagement with the depression 8 as shown in FIG. 3C so that another excess metal of the workpiece W is introduced into the depression 8 to develop the projection G. In like manner, the projection G sequentially comes in engagement with the depressions 6, 9, 7 every half revolution of the workpiece W so as to develop the projection G further as shown in FIG. 3D. Finally, as shown in FIG. 3E, the prejection G is finished by the depression 7, thereby completing the rolling process of the asymmetrical article P. By the rolling process mentioned above, the asymmetrical article P shown in FIGS. 7 and 8 can be obtained.

By the experiments conducted by the applicant, it was found desirable to set the pitch l of the depressions 5, 6, 7 or the depressions 8, 9 at a value about 1.0–1.2 times as large as the distance over which the workpiece W rolls by one revolution (i.e. the circumference of the workpiece W) since there is some slippage between the dies 3, 4 and the workpiece W during rolling, though the desirable pitch l also varies a little depending upon the shape of the article P to be rolled.

Figure 4:
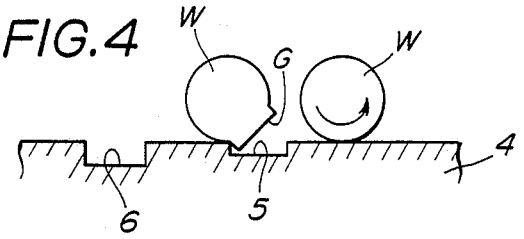
FIGS. 4 and 5 show variants of the die face depressions of FIG. 1.
Figure 5:
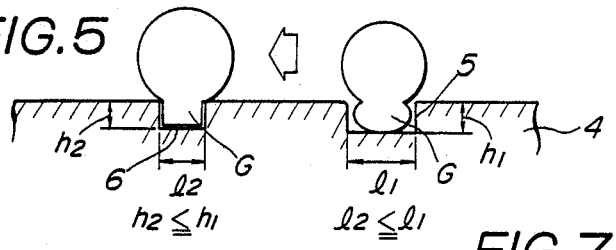

In the foregoing, it will be understood that the number of the depressions is not limitative but may be increased in order to form a larger projection. It will be further understood that three cylindrical dies may be employed to carry out the foregoing rolling process of this invention. In such a case, the depressions of each die are arranged to differ from each other in phase by the amount corresponding to about $\frac{1}{3}$ revolution of the workpiece or differ from each other in position relative to the workpiece by the distance over which the workpiece rolls by $\frac{1}{3}$ revolution. It will be further understood that the depressions may be designed so as to increase in volume progressively as exemplarily shown in FIG. 4 with respect to the depressions 5, 6 or on the contrary the depressions may be designed so as to reduce in volume progressively as exemplarily shown in FIG. 5.

Figure 6:
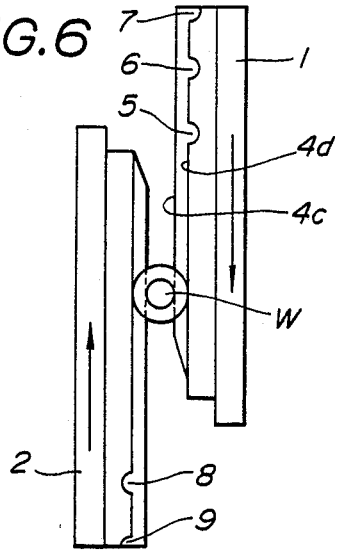
FIG. 6 is a schematic view of a pair of flat dies which can be used in place of the cylindrical dies of FIG. 1.

FIG. 6 shows another embodiment in which a pair of flat dies 1, 2 are used for carrying out the foregoing rolling process of this invention in place of the cylindrical dies 3, 4.

FIGS. 9A to 9D show a method of forming a crankshaft $P_1$ according to a further embodiemnt of the present invention.

Figure 9A:
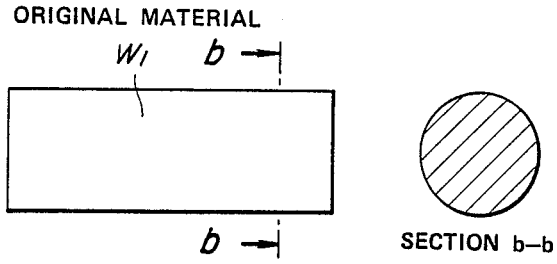
FIGS. 9A–9D are schematic views of a method of forming a crankshaft according to another embodiment of the present invention.
Figure 9B:
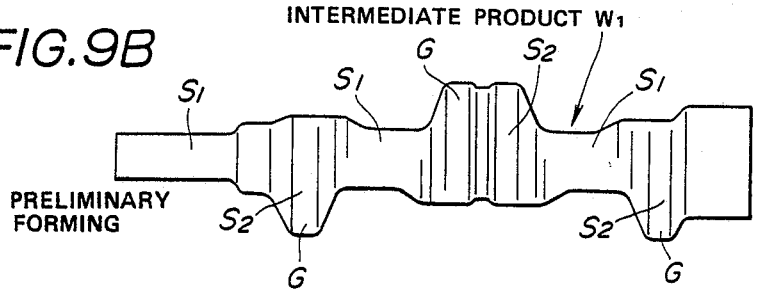

In this embodiment, a workpiece $W_1$ is originally in the form of a straight round bar as shown in FIG. 9A and formed into an intermediate product shown in FIG. 9B by a single preliminary forming process. The intermediate product $W_1$ is asymmetrical about its axis and includes a plurality of symmetrical or concentric shaft sections $S_1$, $S_1$ and a plurality of asymmetrical or eccentric shaft sections $S_2$, $S_2$. The shaft sections $S_1$, $S_2$ are arranged in compliance with the finished shape of the crankshaft or finished product $P_1$ shown in FIG. 9D so that the intermediate product $W_1$ is ready to be forged. The preliminary forming of FIG. 9B is carried out by a rolling process using a pair of cylindrical dies 13, 14 according to the present invention. The dies 13, 14, as shown in FIGS. 10–12 and 13A–13D, are respectively formed with die faces 13*a*, 14*a* including first working sections 13*c*, 14*c* for forming the symmetrical or concentric shaft sections $S_1$ and second working sections 13*d*, 14*d* for forming asymmetrical or eccentric shaft sections $S_2$ having radial projections G.

By this rolling process, a prior art bending process can be dispensed with, which bending process has been indispensable for forming the asymmetrical or eccentric shaft sections $S_2$ in addition to a prior art rolling process.

Figure 9C:
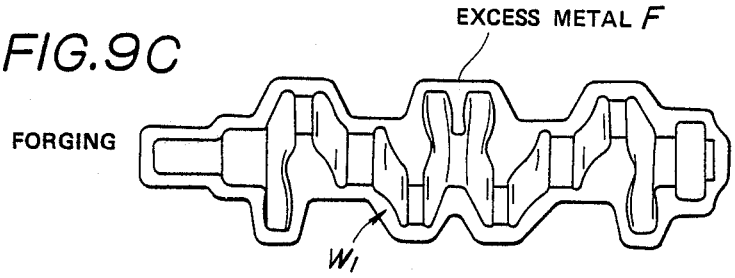
Figure 9D:
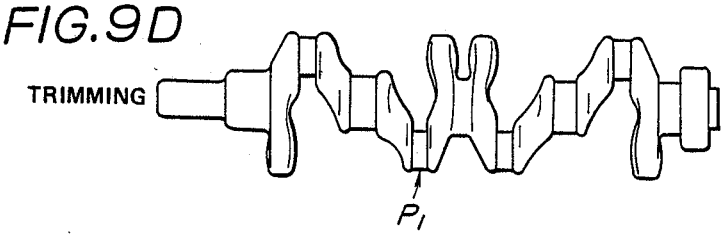
Figure 10:
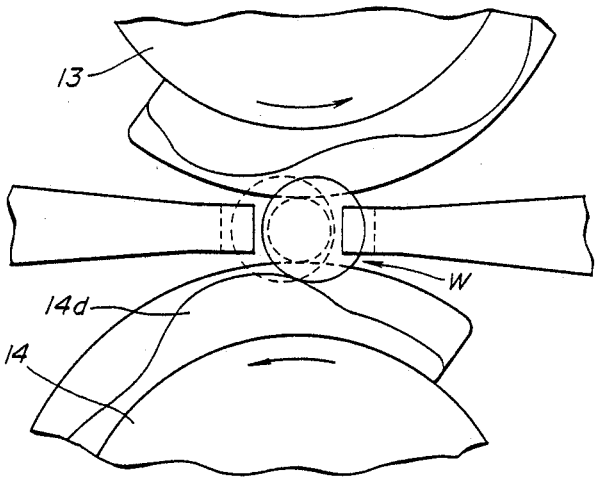
FIG. 10 is a fragmentary side view of a pair of cylindrical dies for rolling the asymmetrical product of FIG. 9B.
Figure 11:
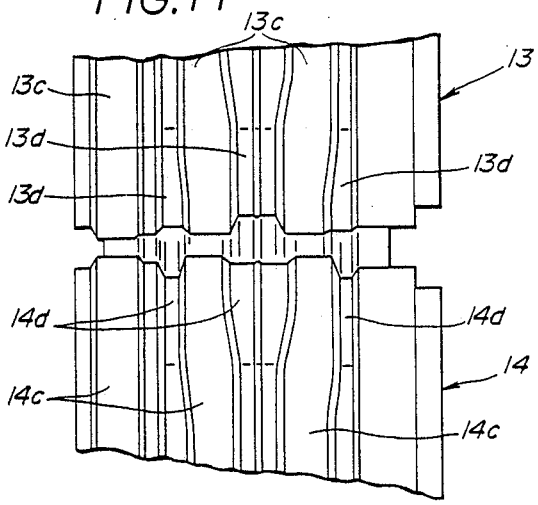
FIG. 11 is an elevational view of the dies of FIG. 10.
Figure 12:
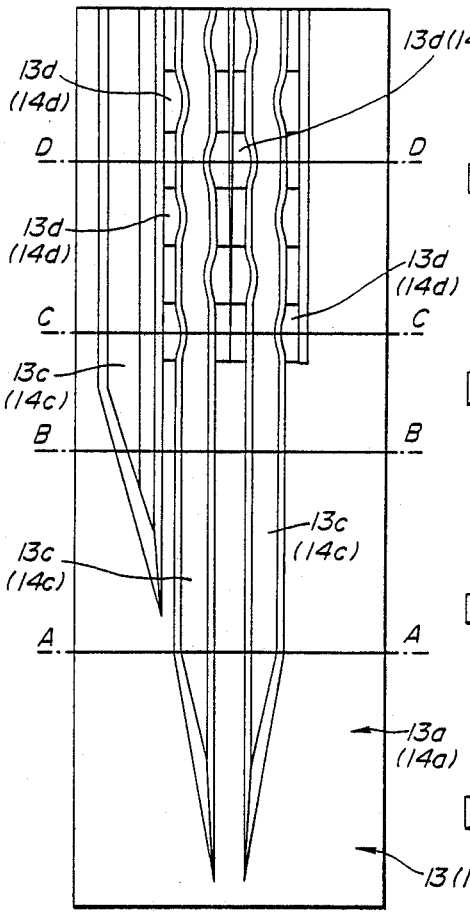
FIG. 12 is a developed view of one of the dies of FIG. 10.
Figure 13D:
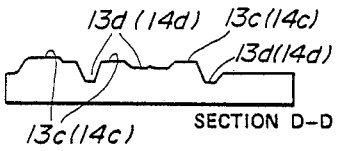
FIG. 13A–13D are sectional views taken along the line a—a, b—b, c—c, d—d of FIG. 12.
Figure 13C:
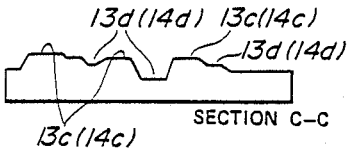
Figure 13B:
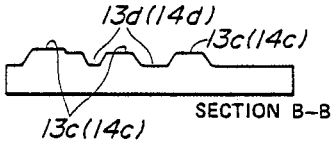
Figure 13A:
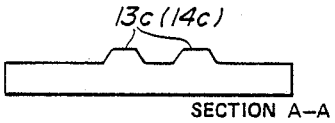

Subsequently to the preliminary forming process of FIG. 9B, a forging process of FIG. 9C is performed twice, i.e., one for roughing and one for finishing. In this forging process, an excess metal portion or flange F is inevitably formed similarly to the prior art. However, since the workpiece $W_1$ can be formed into the shape of FIG. 9B more efficiently than before by the rolling process of this invention, the metal flow occuring in the subsequent forging process becomes more efficient and desirable than before, whereby to make it possible to reduce the volume of the excess metal portion F. After the forging process of FIG. 9C, the excess metal portion F is removed by a trimming process of FIG. 9D, whereby the workpiece $W_1$ is formed into the finished shape of the crankshaft $P_1$.

By this embodiment, the manufacturing expense of the cranckshaft can be reduced considerably since the bending process otherwise necessitated can be dispensed with. Further, by this embodiment, it becomes possible to employ a straight round bar as a workpiece for producing a crankshaft. This is effective for reducing the volume of the excess metal protion to be trimmed.

Figure 14:
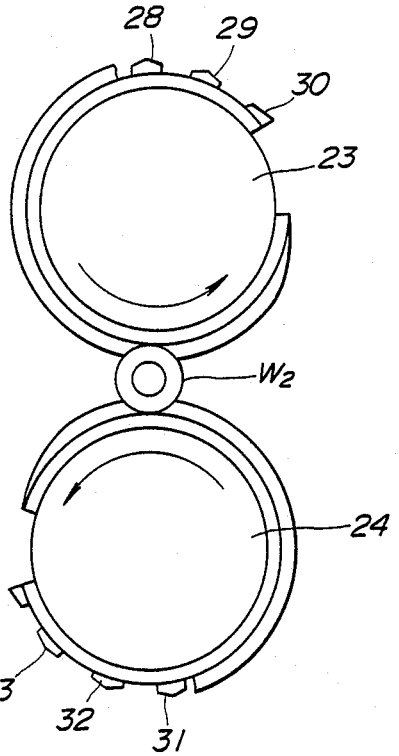
FIG. 14 is a side view of a pair of cylindrical dies according to a further embodiment of the present invention.
Figure 15:
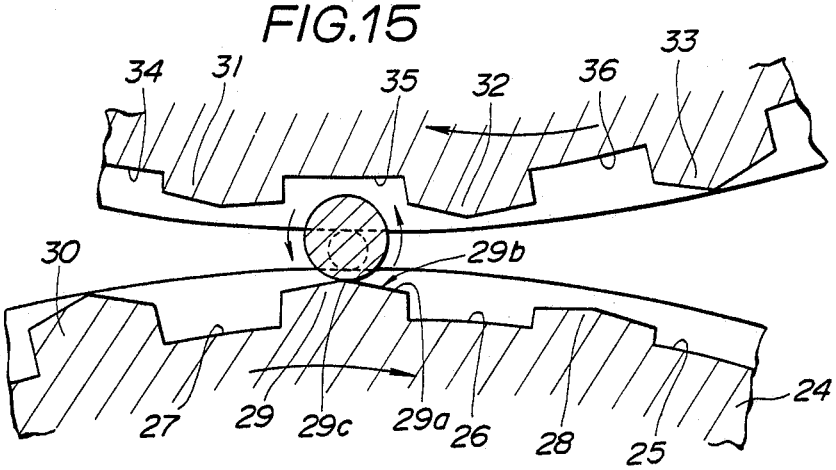
FIG. 15 is an enlarged fragmentary view of the dies of FIG. 14.
Figure 17:
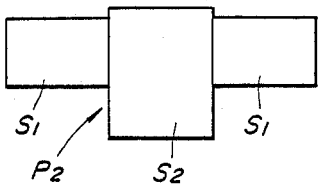
FIG. 17 is an elevational view of an asymmetrical article to be rolled by the dies of FIG. 14.
Figure 18:
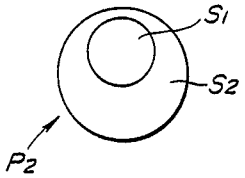
FIG. 18 is a side view of the article of FIG. 17.
Figure 19A:
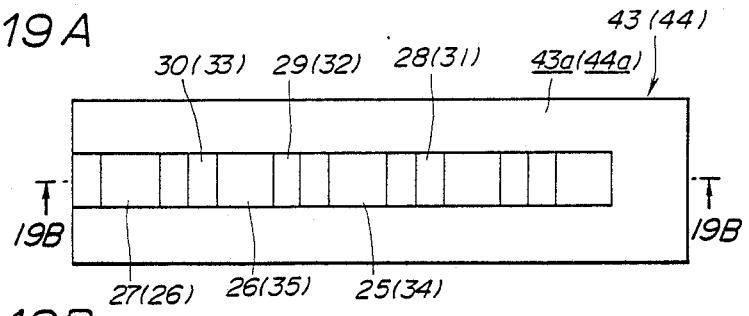
FIGS. 19A–19D are views similar to FIGS. 16A–16D but showing a further embodiment of the present invention.
Figure 19B:
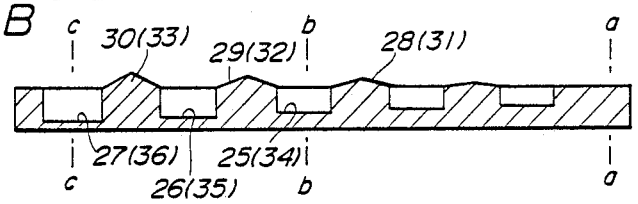
Figure 19C:
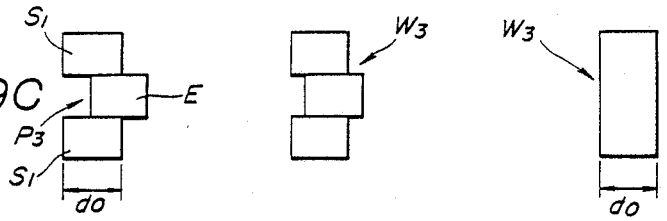
Figure 19D:
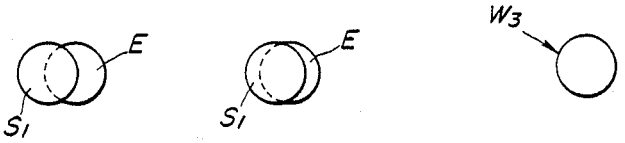

FIGS. 14 and 15 show a further embodiment in which a pair of cylindrical dies 23, 24 are used for rolling an asymmetrical product or article $P_2$ shown in FIGS. 17 and 18.

Figure 16A:
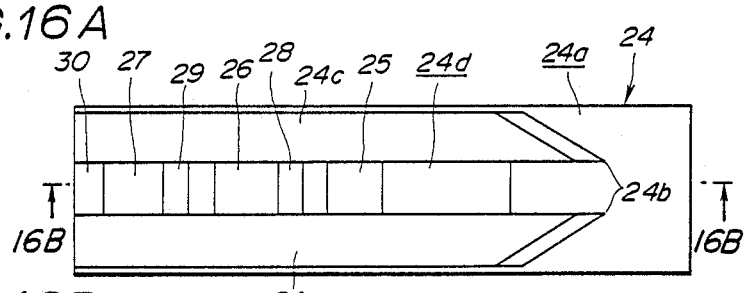
FIG. 16A is a developed view of the die face of one of the dies of FIG. 14.
Figure 16B:
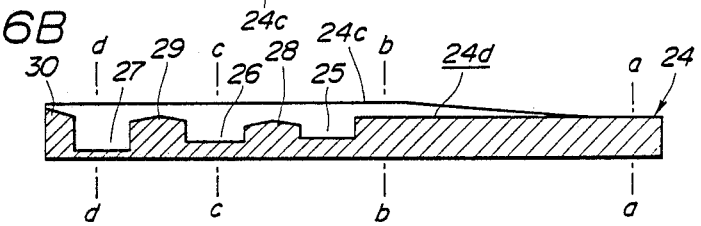
FIG. 16B is a sectional view taken along the line 16B—16B of FIG. 16A.

FIG. 16A is a developed view of the face 24*a* of the die 24, and FIG. 16B is a sectional view taken along the line 16B—16B of FIG. 16A. The die face 24*a* has a pair of first working sections 24*c*, 24*c* each having biting ends 24*b*, 24*b* and adapted for forming the symmetrical or concentric smaller diameter sections $S_1$ and a second working section 24*d* located between the first working sections 24*b*, 24*b* and adapted for forming the asymmetrical or eccentric larger diameter section $S_2$. The second working section 24*d* is formed with alternate depressions 25, 26, 27 and projections 28, 29, 30 in such a manner that the depressions 25, 26, 27 become deeper the remoter they are located from the biting ends 24*b*, 24*b*. while on the other hand the projections 28, 29, 30 become higher the remoter they are located from the biting ends 24*b*, 24*b*. The above structure is substantially similar in case of the other die 23, and the die 23 is formed with alternate projections 31, 32, 33 and depressions 34, 35, 36.

Figure 16C:
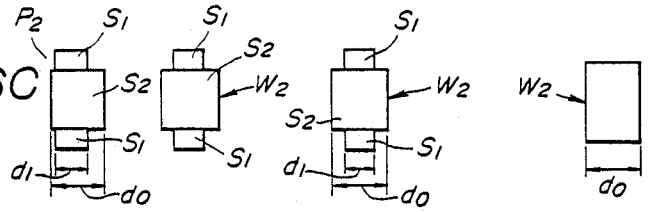
FIG. 16C is an elevational view of variously shaped workpieces obtained at each stages a—a, b—b, c—c, d—d of FIG. 16B.
Figure 16D:
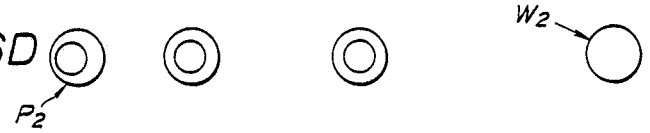
FIG. 16D is a side view of the workpieces of FIG. 16C.

FIG. 16*c* shows the shapes into which the workpiece $W_2$ is formed at each stages a—a, b—b, c—c, d—d. FIG. 16D shows in side elevation the workpiece $W_2$ at the stages a—a, b—b, c—c, d—d. As seen from FIGS. 16B and 16C, rolling of the workpiece $W_2$ begins as the process advances from the stage a—a to the stage b—b. In response to this, the opposite ends of the workpiece $W_2$ start reducing in diameter by the effect of the first working sections 23*c*, 24*c* and formed into the smaller diameter shaft sections $S_1$, $S_1$ of the diameter $d_1$. Up to this stage, the workpiece $W_2$ is held symmetrical about its axis and the diameter $d_0$ of the larger diameter section $S_2$ is maintained unchanged.

Further, at the stage transitting from b—b to d—d via c—c, the diameter $d_1$ of the smaller diameter sections $S_1$, $S_1$ is held unchanged since the first working sections 23*c*, 23*c* have no inclination. While the diameter $d_0$ of the larger diameter section $S_2$ is held unchanged for the similar reason, the eccentricity of the larger diameter section $S_2$ increases progressively.

As shown in FIG. 15, the pitch of the projections 28, 29, 30 of the die 24 and the pitch of the projections 31, 32, 33 of the die 23 are set at a value substantially equal to the distance over which the larger diameter section $S_2$ of the workpiece $W_2$ rolls by one revolution, i.e., the circumference of the larger diameter section or eccentric shaft section $S_2$. Further, the projections 28, 29, 30 of the die 24 differ from the projections 31, 32, 33 of the die 23 in position relative to the workpiece $W_2$ by the distance over which the workpiece $W_2$ rolls by about half revolution, i.e., differ in phase from the projections 31, 32, 33 by the amount corresponding to about half revolution of the workpiece $W_2$ so that any one of the projections 28, 29, 30 and any one of the projections 31, 32, 33 do not come in contact with the workiece $W_2$ at the same time.

Reference being made by way of example to the projection 29 of the die 24 which is matched with the depression 35 of the die 23 as shown in FIG. 15, the eccentricity of the larger diameter section $S_2$ relative to the smaller diameter sections $S_1$, $S_1$ increases progressively during the time when the larger diameter section $S_1$ rolls along the upward slope 29*a* of the top face 29*b* of the projection 29 and maximized when the larger diameter section $S_2$ comes in contact with the upper most point 29*c* of the top face 29*b*. The above occurs similarly in case of the other projections 28, 30 and the projections 31, 32, 33. The larger diameter section $S_2$ is made eccentric in the above manner and constitutes the eccentric shaft section of the asymmetrical article $P_2$ shown in FIGS. 17 and 18.

Figure 20:
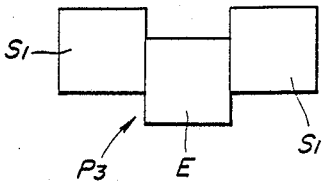
FIG. 20 is an asymmetrical article to be rolled by the dies of FIGS. 19A and 19B.
Figure 21:
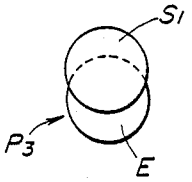
FIG. 21 is a side view of the asymmetrical article of FIG. 20.

FIGS. 19A–19D show a further embodiment whereby the rolling process of this invention is used for manufacturing an asymmetrical article $P_3$ shown in FIGS. 20 and 21. The article $P_3$ has an eccentric shaft section E and concentric shaft sections $S_1$, all of which sections are of the same diameter. In this embodiment, since it is not necessary to change the diameter $d_0$ of the workpiece $W_3$ but the diameter of the finished product $P_3$ is equal to the diameter $d_0$ of the workpiece $W_3$, the die faces 43*a*, 44*a* of the cylindrical dies 43, 44 are not provided with such first working sections as are provided in the previous embodiment of FIGS. 14–15 and 16A–16D.

Figure 22A:
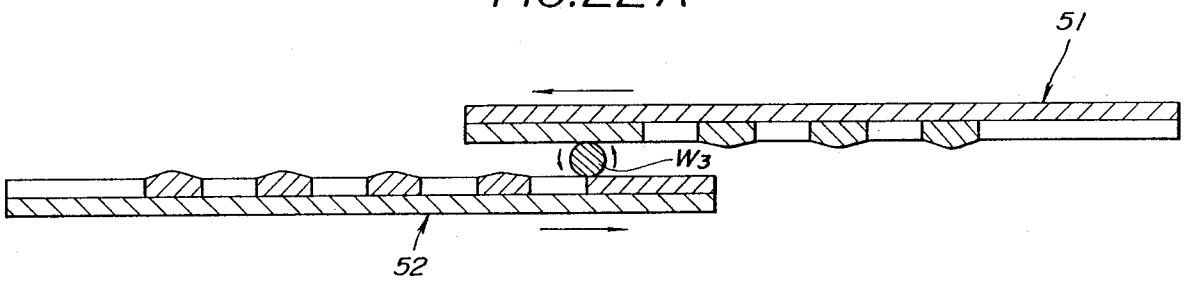
FIGS. 22A and 22B are sectional views of a pair of flat dies for rolling the article of FIGS. 20 and 21.
Figure 22B:
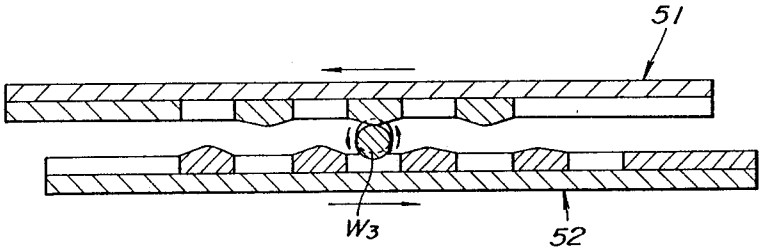

FIGS. 22A and 22B show a further embodiment in which a pair of flat or straight dies 51, 52 are used for carrying out the same rolling process as the previous embodiment of FIGS. 19A–19D.

Figure 25:
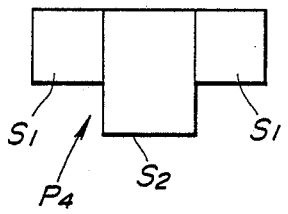
FIG. 25 is an elevational view of an asymmetrical article to be rolled by the dies of FIGS. 23A and 23B.
Figure 26:
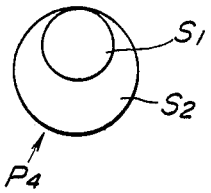
FIG. 26 is a side view of the article of FIG. 25.
Figure 23A:
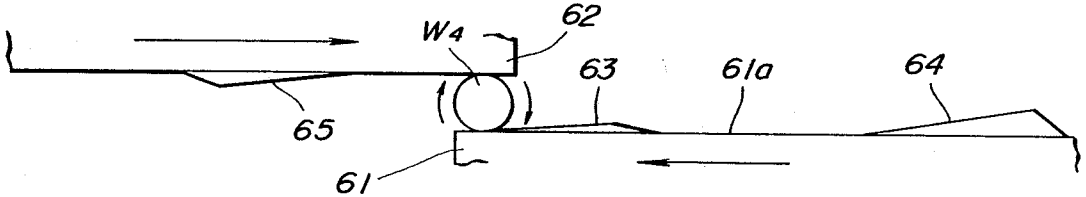
FIGS. 23A and 23B are schematic views of a pair of flat dies according to a further embodiment of the present invention.
Figure 23B:
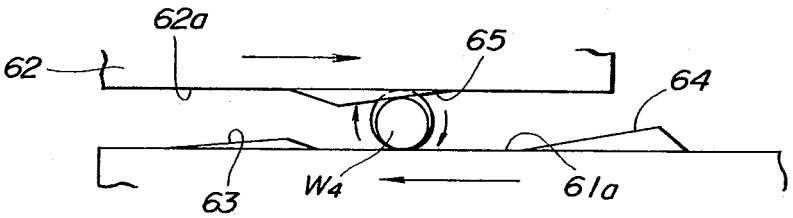

FIGS. 23A and 23B show a further embodiment wherein a pair of flat or straight dies 61, 62 are used for rolling an asymmetrical article $P_4$ shown in FIGS. 25 and 26.

Figure 24A:
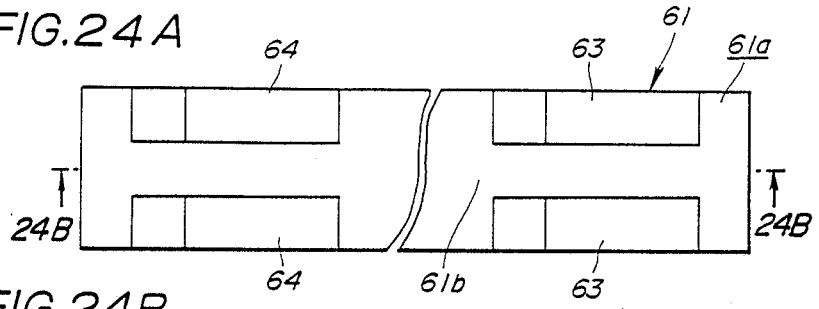
FIG. 24A is a developed view of the die face of one of the dies of FIGS. 23A and 23B.
Figure 24B:
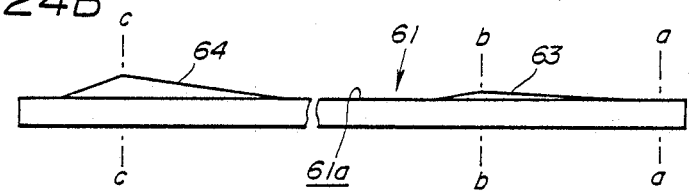
FIG. 24B is a sectional view taken along the line 24B—24B of FIG. 24A.

FIG. 24A is a plan view of the die face 61*a* of the die 61, and FIG. 24B is a sectional view taken along the line 24B—24B of FIG. 24A. The die face 61*a* is formed with a plurality of projections 63, 64 for forming the eccentric shaft sections $S_1$, $S_1$ of the asymmetrical article $P_4$. More specifically, the die face 61*a* consists of a generally planar surface section 61*b* and plural pairs of projections 63, 63 or 64, 64, each pair of which projections 63, 63 or 64, 64 are aranged so as to oppose in the width direction of the die 61 and symmetrically about the longitudinal center axis of the die 61. The other die 62 is substantially similar to the die 61 except that it is formed with a pair of projections 65, 65 only. The projections 63, 64, 65 have angled top faces **63*b*, 64*b*, 65*b* and are of the heights that vary in such a manner that the projections 65 is higher than the projection 63 and the projection 64 is higher than the projection 65. The projections 63, 64, 65 resemble each other in shape, and the angled top faces 63*b*, 64*b*, 65*b* are respectively provided with upward slopes 63*c*, 64*c*, 65*c* and downward slopes 63*d*, 64*d*, 65*d*** in such a manner that the upward slopes are more gentle than the downward slopes.

Figure 24C:
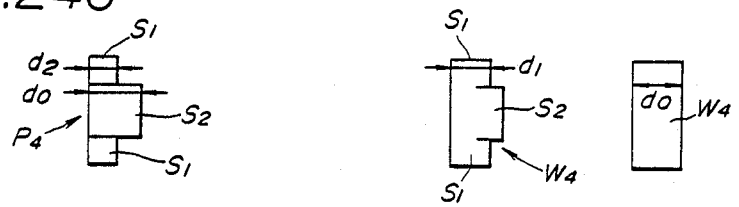
FIG. 24C is an elevational view of variously shaped workpieces obtained at each stages a—a, b—b, c—c, d—d of FIG. 24B.
Figure 24D:
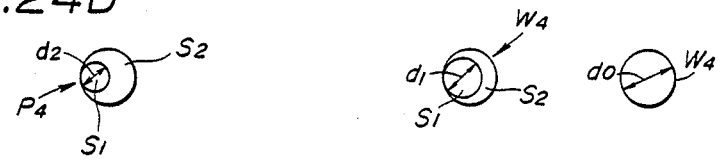
FIG. 24D is a side view of the workpieces of FIG. 24C.

FIG. 24C shows the shapes into which the workpiece $W_4$ is formed at the stages a—a, b—b, c—c of the rolling process shown in FIG. 24B and FIG. 24D shows in side elevation the workpiece $W_4$ at those stages. As seen from FIGS. 24B and 24C, rolling of the workpiece $W_4$ begins as the process advances from the stage a—a to the stage b—b whereby the opposite end portions of the workpiece $W_4$ which are to be formed into the eccentric sections $S_1$, $S_1$ are reduced in diameter to $d_1$ ($d_0 > d_1$) while at the same time the axes of the opposite end portions are caused to become eccentric progressively. In this case, the diameter $d_0$ of the larger diameter section $S_2$ is maintained unchanged.

Further, as the process advances from the stage b—b to the stage c—c, the eccentric portions $S_1$, $S_1$ are further reduced in diameter to $d_2$ ($d_1 > d_2$) by the effect of the projection 64, while at the same time the eccentricity of the eccentric portions $S_1$, $S_1$ are further increased so that the circumferential surface of the eccentric portions $S_1$, $S_1$ becomes in part flush with that of the larger diameter section $S_2$. In this stage, the diameter $d_0$ of the larger diameter section $S_2$ is still maintained unchanged.

As shown in FIGS. 23A and 23B, the pitch of the projections 63, 64 of the flat dies 61 are set at a value substantially equal to the distance over which the larger diameter section $S_2$ rolls by one revolution, i.e., equal to the circumference of the larger diameter section $S_2$, and the projection 65 is arranged so as to differ from the projections 63, 64 in phase by the amount corresponding to about half revolution of the workpiece $W_4$, i.e., so as to differ from the projections 63, 64 in position relative to the workpiece $W_4$ by the distance over which the workpiece $W_4$ rolls by about half revolution such that the projection 65 does not come in contact with the workpiece $W_4$ together with either of the projections 63, 64.

Accordingly, as shown in FIGS. 23A and 23B, the eccentricity of the eccentric shaft sections $S_1$ $S_1$ is increased as the workpiece $W_4$ rolls along the upward slopes of each projections. At the same time when the workpiece $W_4$ finishes rolling along the downward slope of the projection 63, it begins to roll along the upward slope of the projection 65. In this manner, the workpiece $W_4$ rolls from the projection 65 to the projection 64. The eccentricity of the eccentric shaft section $S_1$, $S_1$ is maximized when the eccentric shaft sections $S_2$, $S_2$ are brought into engagement with the upper most point of the top face of the projection 64, whereby the workpiece $W_4$ is formed into the asymmetrical article $P_4$ shown in FIGS. 25 and 26. In the meantime, the reduction in diameter of the eccentric shaft sections $S_1$, $S_1$ and the eccenticity of same can be varied by varying the heights of the projections 63, 64, 65.

In this embodiment, by providing an inclination to the working sections **61*b*, 62*b* of the die faces 61*a*, 62*a*, the diameter $d_0$ of the larger diameter section $S_2$ can be changed. By making the pair of projections different from each other in height, the eccentric shaft sections $S_1$ can be made different in diameter from each other. Further, it will be understood that in place of the flat dies 61, 62** a pair of cylindrical dies may be used.

What is claimed is:

1. A device for forming an asymmetrical article by rolling, comprising:

a plurality of driven cylindrical dies in fixed, spaced apart relation to each other between which an article may be clamped to be rolled as said dies are driven in opposite rotational directions, said dies being rotatable about parallel axis and having means for rotatably clasping said article about its axis so that the axis of said article extends parallel to said die axis, said dies each having die faces which are formed with circumferentially spaced independent patterns separated from each other in the direction of rolling of the article and capable of being sequentially brought into engagement with a particular portion of the article for thereby forming a part of the article at said particular portion, said part of the article being asymmetrical about the axis of the article.

2. A device for forming an asymmetrical article by rolling, comprising:

a pair of first and second cylindrical dies in fixed, spaced apart relation to each other, said dies having dies faces, means to drive said dies in opposite rotational directions, said dies being rotatable about parallel axis and having means for rotatably clasping said article about its axis so that the axis of said article extends parallel to said die axis, said dies each being formed with depressions on their faces which may be sequentially brought into engagement with a particular portion of an article as the article is rolled between said die faces;

said depressions of said first and second dies being separated from each other in the direction of rolling of the article and arranged at the same, constant pitch;

said depressions of said first die being arranged so as to differ in phase from said second die by an amount corresponding to about half revolution of the dies so that said depressions produce an asymmetrical shape of the article about the axis of the article.

3. A device as set forth in claim 2 wherein said depressions of said first and second dies are of different volume and the volume of the depressions of the second pair of dies is greater than the volume of the depressions in the first pair of dies.

4. A device as set forth in claim 8 wherein said depressions of said first and second dies are of different volume and the volume of the depressions in the second pair of dies is less than the volume of the depressions in the first pair of dies.

5. A device as set forth in claim 8 wherein each of said die faces is formed with a pair of first working sections in the form of ridges and a second working section between said pair of first working sections which is lower in height, said second working section also being formed with depression and being provided with an inclination.

6. A device for forming an asymmetrical article by rolling, comprising:

a pair of first and second cylindrical dies in fixed, spaced apart relation to each other, said dies having die faces, means to drive said dies in opposite directions, said dies being rotatable about parallel axis and having means for rotatably clasping said article about its axis so that the axis of said article extends parallel to said die axis, said dies each being formed with alternate depressions and projections on said die faces which are, sequentially brought into engagement with a particular portion of an article as the article rolls between said die faces;

said projections of said first and second dies being separated from each other in the direction of rolling of the article and arranged at the same, constant pitch;

said depressions and projections of said first die being so formed as to differ in phase from said depressions and projections of said second die by the amount corresponding to about half revolution of the dies so that said depressions and projections produce an asymmetrical shape of the article about the axis of the article .

7. A device as set forth in claim 6 wherein said depression and projections of said first and second dies are of different volume.

8. A device as set forth in claim 7 wherein each of said projections has an angled top which are of the same inclination.

9. A device as set forth in claim 8 wherein said article has a pair of concentric smaller diameter sections and an eccentric larger diameter section between said concentric smaller diameter sections, each of said die faces having a pair of first working sections in the form of ridges for forming said concentric smaller diameter sections and a second working section between said first working sections and constituted by said depressions and projections for forming said larger diameter section, said projections being generally lower in height than said first working section.

10. A device as set forth in claim 8 wherein said article has a pair of concentric shaft sections and an eccentric shaft section between said concentric shaft sections, which shaft sections are all of the same diameter, each of said die faces having a pair of first working sections in the form of a flat surface for forming said concentric shaft sections and a second working section between said first working sections and constituted by said depressions and projections for forming said eccentric shaft section, said projections being generally higher in height than said first working sections.

11. A device for forming an asymmetrical article by rolling comprising:

at least one pair of generally cylindrical dies in fixed, spaced apart relation to each other, means to drive said cylindrical dies in opposite clockwise and counterclockwise rotation, respectively, each cylindrical die having a different independent pattern on the surface thereof, said dies being rotatable about parallel axis and having means for rotatably clasping said article about its axis so that the axis of said article extends parallel to said die axis, the pattern on one die being circumferentially offset with respect to the pattern on the other die in the rolling direction and being so configured as to be capable of producing an asymmetrical cross section on an article about its axis while being driven between said dies.

12. A device according to claim 1 further comprising: dies, a plurality of pairs of said cylindrical each of said cylindrical dies having a different independent pattern on the surface thereof and the pattern on each die of a pair being offset with respect to the pattern on the other die in the rolling direction.

* * * * *